United States Patent [19]

Ashikian

[11] Patent Number: 4,460,319

[45] Date of Patent: Jul. 17, 1984

[54] TWO-STAGE ROTARY COMPRESSOR

[76] Inventor: Baruir Ashikian, 505 rue Frechette, Sherbrooke, Quebec, Canada

[21] Appl. No.: 460,843

[22] Filed: Jan. 25, 1983

[30] Foreign Application Priority Data

Feb. 8, 1982 [CA] Canada ..... 395794

[51] Int. Cl.[3] ..... F04B 23/10; F04B 1/12; F01B 13/04

[52] U.S. Cl. ..... 417/204; 417/243; 417/269; 417/486; 91/507

[58] Field of Search ..... 417/199, 204, 243, 486, 417/269; 91/507

[56] References Cited

U.S. PATENT DOCUMENTS

| | | | |
|---|---|---|---|
| 2,150,122 | 3/1939 | Kollberg et al. | 417/243 |
| 2,504,841 | 4/1950 | Jones | 417/204 |
| 3,664,272 | 5/1972 | Pamariti | 417/486 |

FOREIGN PATENT DOCUMENTS

| | | | |
|---|---|---|---|
| 1108009 | 9/1981 | Canada . | |
| 1056935 | 5/1959 | Fed. Rep. of Germany | 91/507 |

*Primary Examiner*—Richard E. Gluck
*Assistant Examiner*—Peter M. Cuomo
*Attorney, Agent, or Firm*—Cushman, Darby & Cushman

[57] ABSTRACT

A two-stage rotary compressor makes use of a piston-vane arrangement where both stages are built side-by-side and where the same members (piston-vanes) work for both stages, the "axial pistons" of the second stage becoming the dividing "vanes" in the first stage.

16 Claims, 12 Drawing Figures

TWO-STAGE ROTARY COMPRESSOR

FIELD OF THE INVENTION

The present invention relates to a two-stage compressor.

BACKGROUND OF THE INVENTION

The power saving obtained in two-stage compression with intercooling is a well known fact but double-staging is usually applied for high pressure ratios and for important size units. The ever increasing energy cost leads to the increased use of two-stage compressors in the field of modest pressure ratios such as encountered in shop air requirements and in that of small units. Another factor to influence selection of the compressors, pumps, etc., is the increased use of variable speed a.c. electrical motors which may provide power savings by varying the compressor speed in response to the requested output. These two factors are unlikely to favour the existing rotary compressors available on the market i.e. the oil flooded vane type and the dry or oil flooded screw type.

Vane compressors already available in two-stage designs suffer from several drawbacks: high leakage area, hence high oil circulation for a given displacement; high rubbing speeds; vane sticking problems which imply the necessity of operating within a narrow range of rotational speed; and an overall high power consumption.

Screw compressors, although popular, are seldom used for two-stage operations because they usually require two complete separate units interconnected via an intercooler with the result that this leads to an expensive arrangement. Moreover, its performance is dependent upon its rotational speed and, therefore, output control via speed control will not produce any significant power saving.

The above mentioned technics would favour the classical reciprocating compressor which, when properly designed, has an inherent ability to operate over a wider range of speeds and has less power consumption than the equivalent two rotary volumetric compressors.

A rotary compressor with less leakage area than that in the vane compressor, with double-staging at reasonable cost and with the ability to operate at various speeds while maintaining a satisfactory performance, will maintain a continued competitive edge over the reciprocating compressor.

OBJECTS AND STATEMENT OF THE INVENTION

It is an object of the present invention to overcome the drawbacks of the above mentioned rotary compressor types by providing a rotary compressor where both stages are built side-by-side in the same rotor resulting in a compressor which is compact and has a minimum number of parts thereby causing less friction and being of lower cost. In the compressor of the present invention, the same members (piston-vanes) work for both stages, the "axial pistons" of the second stage becoming the dividing "vanes" in the first stage. The compressor makes use of a vane arrangement such as described in applicant's Canadian Pat. No. 1,108,009 issued Sept. 1, 1981 and entitled "Rotary axial vane mechanism".

The two-stage compressor includes, in its broadest aspect: a casing; a longitudinally extending center boom mounted centrally within the casing; a rotor concentrically mounted on the boom; a first-step head assembly at one end of the casing; cam means fixedly mounted within the casing; cylindrical piston-vane means rotatably and axially displaceable in the rotor; and means inside the casing for passing gas from a first stage compression to a second stage compression.

The center boom has a hollow portion defining a gas collecting sector and a gas passage sector; a first port collects compressed gas in the collecting sector while a second port discharges the compressed gas from the center boom.

The rotor consists of:

(i) a hollow cylindrical core;

(ii) a cylindrical sleeve concentrically surrounding a portion of the core to define therewith an annular space;

(iii) an annular wall joining the sleeve and the core, the annular wall having, on one side thereof, a frusto-conical surface and circular openings therethrough; and (iv) hollow cylinders longitudinally extending on the opposite side of the wall, the cylinders having one open end in axial registry with the circular opening in the wall and the opposite end closed; the cylindrical bore of the cylinders having a diameter greater than the width of the annular space, each cylinder having a port adapted to come in cyclic registry over the first port of the boom.

The first-stage head assembly includes a pair of separate chambers and has an inclined plane surface facing the frusto-conical surface; both surfaces are in close proximity along a portion thereof, the plane surface including inlet and outlet ports thereon communicating respectively with the pairs of chambers of the head. The cam means have an inclined plane surface that extends parallel to the inclined plane surface of the head; also the cam means face the closed end of the cylinders.

Each cylindrical piston-vane means include two coaxial adjoining bars of different outside diameters, the larger being substantially equal to the inside diameter of the cylindrical bores in the rotor; the plane free ends of these bars are parallel to each other and inclined with respect to their common longitudinal axis while the adjoining ends are perpendicular to this axis. Each piston-vane means is housed in its respective cylindrical bore in the rotor with its rod-like portion of smaller diameter (piston-rod) traversing the closed end of its respective cylinder while the larger portions (piston-vanes) devide the annular space in several working chambers. The total length of each piston-vane means and the inclination of the free plane ends are such that the inclined plane end of the piston-vane remains in continuous complete sliding contact with the inclined plane surface of the first-stage head while the inclined plane end of the piston-rod does likewise with the inclined surface of the cam. The shaft rotation causes a rotation of each piston-vane means around its own axis and concomittently a longitudinal (axial) displacement, thereby varying cyclically the volumes of the first stage working chambers in the annular space and the volumes within the longitudinally extending cylinders serving in a second stage role.

The aforementioned embodiment might be regarded as a "single acting" two-stage compressor. The same concepts can be readily applied to a "double acting" two-stage compressor which has two sets of three piston-vanes, two adjacent identical piston-vanes making 60° between themselves and being oriented in opposite directions. The cam in the single acting embodiment is replaced with a first stage head similar to that existing at the drive end. The rotor has two identical annular spaces separated by a midportion containing six hollow cylinders, each having a piston-vane. The frusto-conical surface of each of the two annular walls has equally spaced circular openings of two different, alternating diameters: the large openings are traversed by the vane ends of one set of the piston-vanes while the smaller openings are traversed by the piston rods of the second, opposite set of piston-vanes. The inclined ends of piston-vanes remain in continuous sliding contact with the inclined parallel surfaces of the two first stage heads located at the ends of the casing. The three vane ends divide the respective annular space in three working chambers, each such chamber including a reciprocating-rotating piston rod of the opposite set which reduces slightly the max. volume of the chamber but does not interfere with the admission and/or expulsion of the gas to be compressed. The admission of the gas from the intercooler (the annular spaced defined between the inner wall of the casing and the outer wall of the rotor) is done via openings located between the hollow cylinders in the rotor's hollow cylindrical core. These openings lead to a cavity in the central boom which communicates cyclically with a port in each cylinder close to the small opening in the annular wall. The cyclic discharge from these second stage cylinders is led to the second port of the center boom located at the center of the first stage head at the non drive end.

The scope of applicability of the present invention will become apparent from the detailed description given hereinafter; it should be understood, however, that this description, while indicating preferred embodiments of the invention is given by way of illustration only since various changes and modifications within the spirit and scope of the invention will become apparent to those skilled in the art.

DETAILED DESCRIPTION—SINGLE ACTING COMPRESSOR

Figures 1, 10, 11:
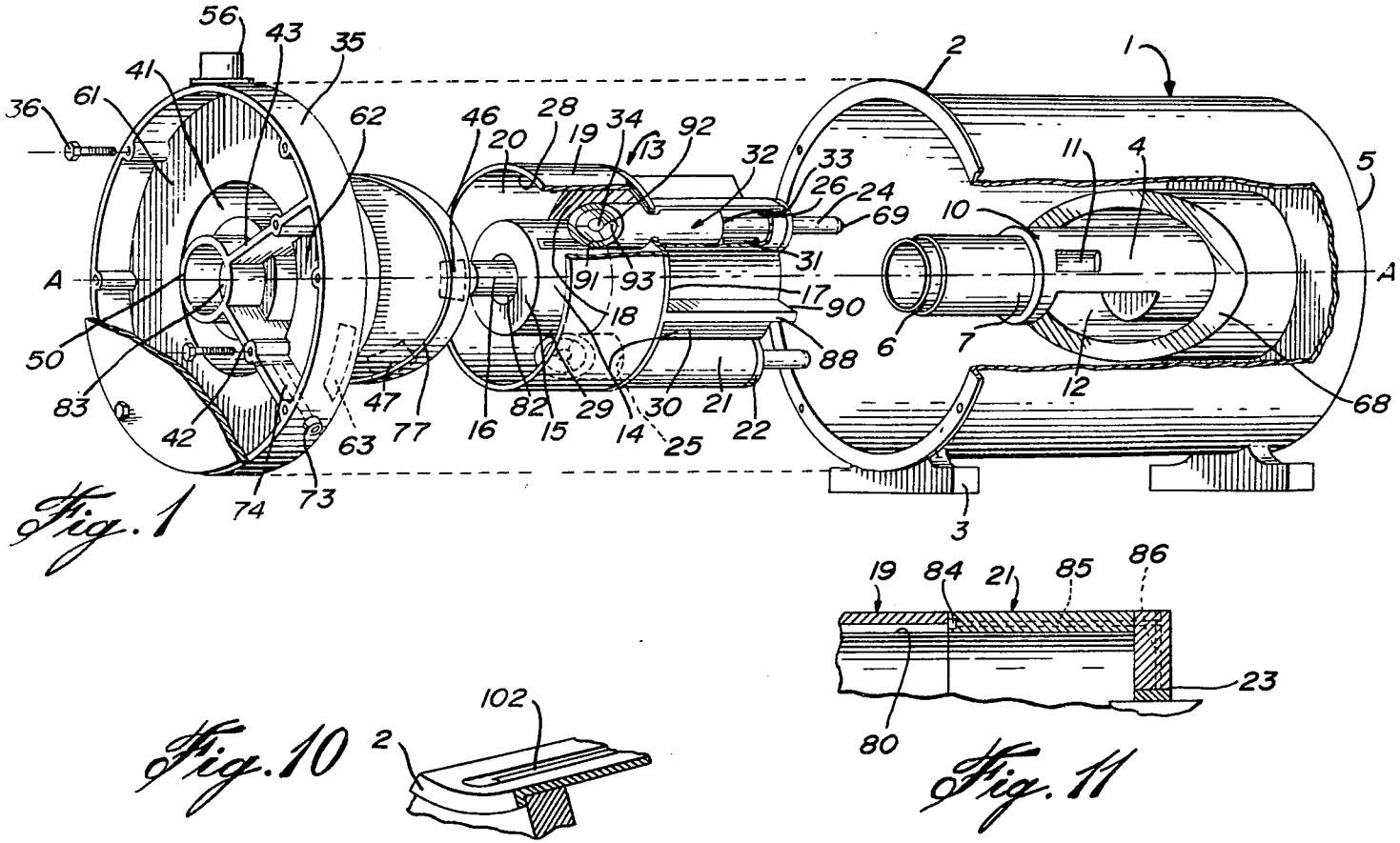
FIG. 1 is an exploded perspective view, with parts partially broken away, showing a single acting two-stage compressor made in accordance with the present invention (the cooling means have been removed for clarity)
FIG. 10 is an enlarged perspective view of a groove in the casing; this figure is shown on the same sheet as FIG. 1.
FIG. 11 is an enlarged partial cross-sectional view, in the region of the cylinders, of the rotor sleeve seated on the rotor; this figure is shown on the same sheet as FIG. 1.
Figure 8:
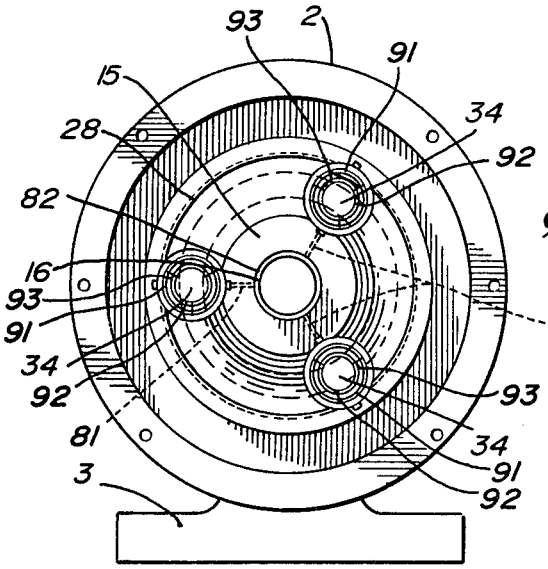
FIG. 8 is a front elevational view showing the single acting compressor with the first-stage head and intercooler coils and baffles removed; this figure is shown on the same sheet as FIG. 2.
Figure 9:
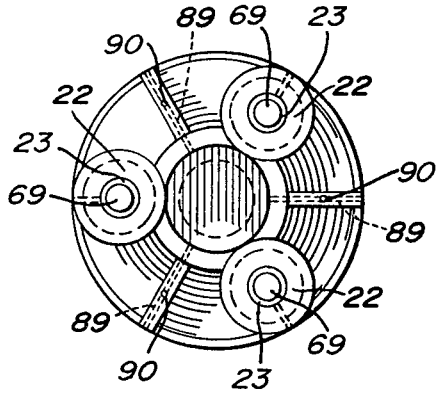
FIG. 9 is an end elevational view of the rotor; this figure is shown on the same sheet as FIG. 2.
Figure 2:
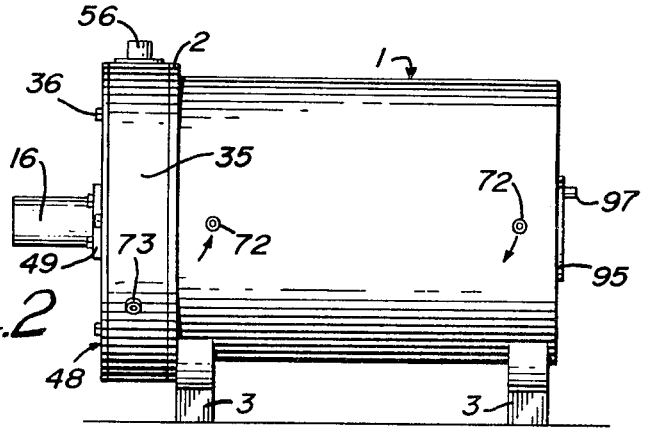
FIG. 2 is a side elevational view of the compressor shown in FIG. 1.

The casing 1 consists of a substantially cylindrical drum having a longitudinal axis A—A; the drum has a flange 2 at its open end, legs 3 for bolting down the compressor to its supporting frame (not shown) and a center boom 4 which protrudes inwards from the end wall 5. The drum walls and the flange are thick enough to withstand the first stage discharge pressure as explained below. The oil tank (not shown) is usually bolted directly to the underside of the legs and communicates with the interior of the casing and the cavity collecting the second stage output. The center boom 4 consists of several thick walled cylindrical portions concentric to and located along the axis A—A, the outermost portion 6 acting as a bearing seat and being closed at its end, while a second portion 7, closer to the end wall acts as the seat for a second bearing. Next to the second portion, the boom has an upper cylindrical surface 10 concentric with the axis A—A; this surface extends over an arc of 210° and has a port 11 which collects the gas-oil mixture discharged from the second stage cylinders as described below. The cylindrical sector 10 is completed with a recessed intake sector 12 through which passes the gas of the intercooler before being admitted in the second stage cylinders. A rotor 13 is mounted on the center boom 4; it has an inner hollow cylinder 14 which contains the bearings 8 and 9 seating, when assembled on the respective seats 6 and 7 on the boom. The cylinder 14 is closed at one end with a wall 15 to which is attached a drive shaft 16. The rotor also contains:

- an annular wall 17 located at midlength around the outer periphery of the cylinder 14; this wall has a conical surface 18 pointing towards the shaft end;
- a cylindrical sleeve 19 concentric with the inner cylinder 14, this sleeve joining the outer periphery of the conical surface 18 and thereby creating an annular open ended space 20;
- several equally spaced hollow cylinders 21 with their longitudinal axis parallel to A—A; these cylinders join the outer periphery of cylinder 14 and the back of the annular wall 17 and each is closed at its free end with a cover 22 equipped with a center bushing 23 through which reciprocates and rotates a piston-rod 24 concentric with the bore of the cylinder 21.

The opened ends of these cylinders communicate with the annular space 20 via circular openings 25 in the annular wall 17 and the conical surface 18. The bores 26 in the cylinders 21 exceed the width of the annular space 20 and extend into the annular space almost over its entire length thereby creating a circular arc recess 27 in the inner surface 28 of the cylindrical sleeve 19 and a circular arc recess 29 in the outer surface 30 of the hollow cylinder 14.

Each cylinder 21 contains, next to its cover 22, a port 31 which establishes a communication between the inside of cylinder 21 and the interior of the boom 4 via port 11. When the rotor rotates around the center boom, ports 31 contact, successively, the intake and collecting sectors thereby admitting and then expelling the gas-oil mixture into and out from the second stage cylinders.

Located within each bore 26 is a light-weight circular piston-vane 32 which has a straight end 33 with piston-rod 24 protruding therefrom and an inclined plane end 34 making with the axis A—A an angle equal to the apex angle of the conical surface 18; the piston-rod also ends with an inclined plane 69 parallel to end 34.

Each piston-vane slides with very little radial play within its corresponding bore and corresponding recesses in surfaces 28 and 30. For every full rotation of the rotor, the piston-vane executes a complete axial back and forth stroke and a complete rotation around its own axis.

The first-stage head 35, which is bolted to the flange 2 with bolts 36, carries on its inner face a annular protrusion 37 consisting of two concentric walls 38 and 39 and an inclined wall 40 which closes the inner end of the annular protrusion 37; the walls 38, 39 and 40 define an annular space 41 which extends toward the open end of the head and which is divided in two compartments 61 and 62 by two webs 42 and 43.

The inclined wall 40 has an inclined plane surface 44 which makes with the axis A—A an angle equal to that of the apex angle of the conical surface 18. When installed, the annular protrusion penetrates with little radial clearances into the annular space 20 of the rotor.

The inclined plane surface 44 carries at its highest point a shallow conical radial recess 45 of a width inferior to the diameter of the bores 26; when assembled, the inclined plane of the first-stage head and the conical surface of the rotor remain in continuous sliding contact along the recess 45.

Openings 46 in the inclined wall, next to the recess 45 acts as an outlet port for the first stage; other openings 47 located on the other side of the recess acts as an inlet port for the first stage.

Each of these ports communicates with one of the compartments created by the webs 42 and 43, these compartments being covered with a first stage cover 48 secured with the same bolts 36. This cover has a hub 49 which extends the hub 50 of the first-stage head.

Figures 3, 6, 7:
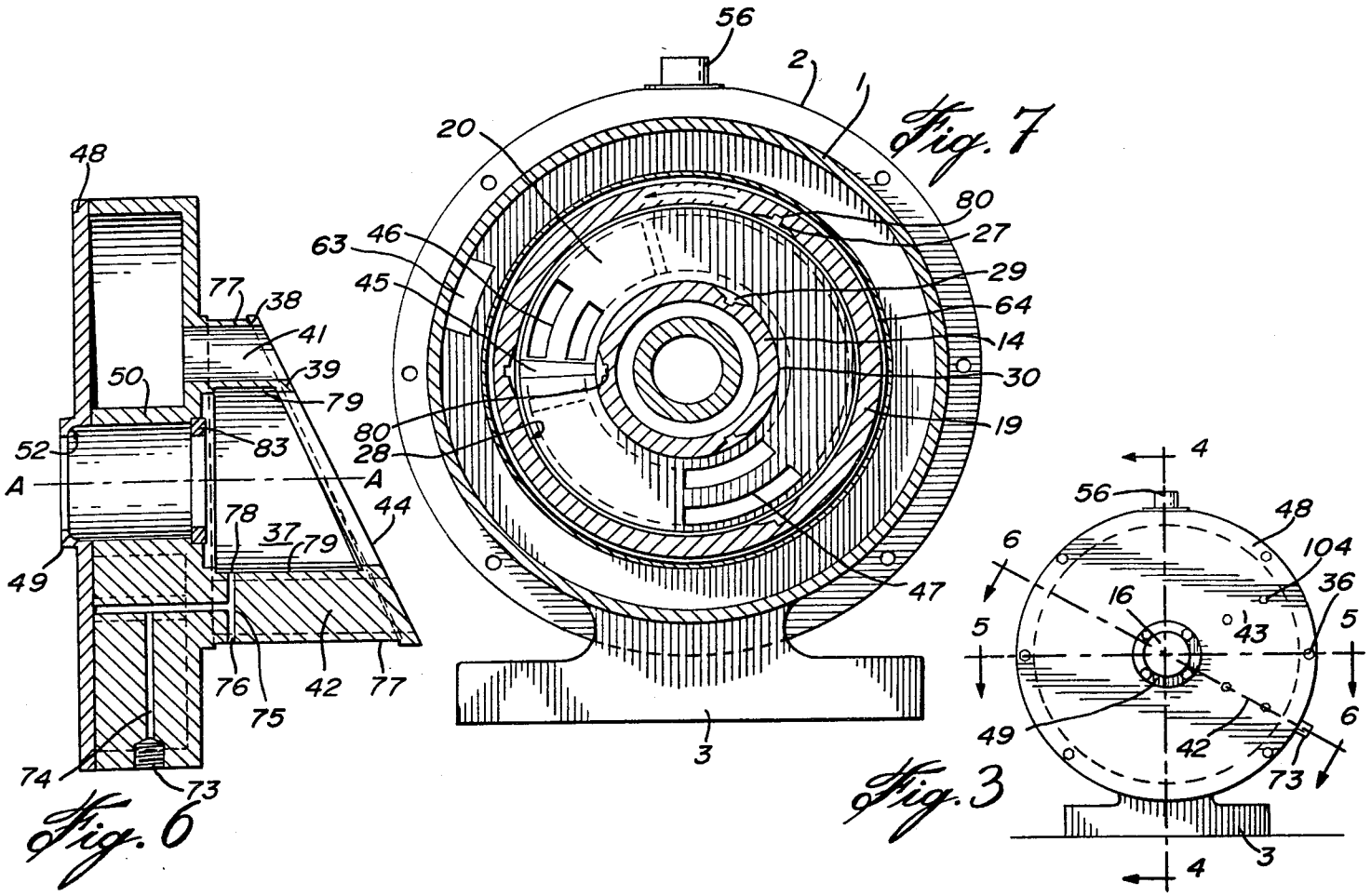
FIG. 3 is an end view of the compressor as seen from the left of FIG. 2.
FIG. 6 is a cross-sectional view of the first stage head of the compressor, taken along lines 6—6 of FIG. 3; this figure is shown on the same sheet as FIG. 3.
FIG. 7 is a cross-sectional view taken along lines 7—7 of FIG. 4 and is shown on the same sheet as FIG. 3 (the cooling coils and baffles have been removed for clarity)
Figure 5:
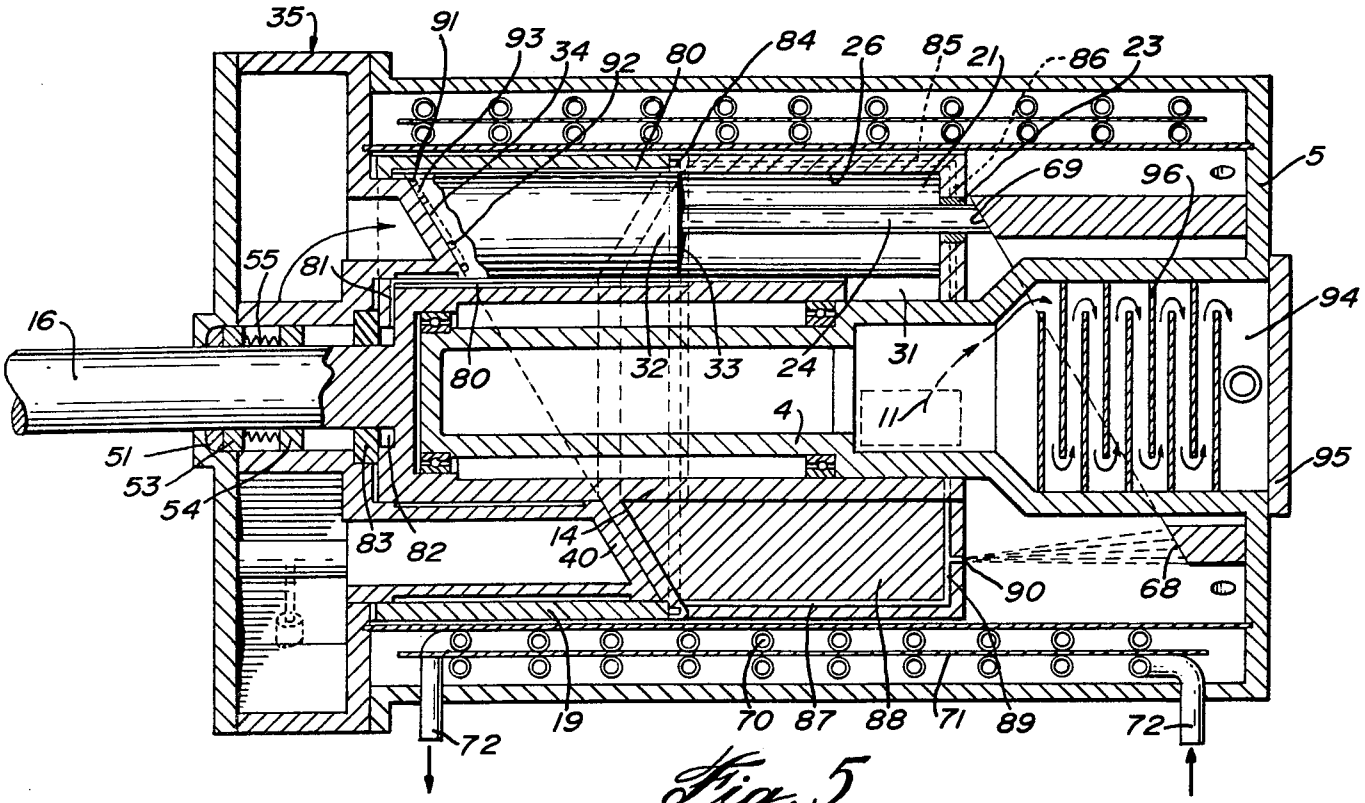
FIG. 5 is a cross-sectional view taken along lines 5—5 of FIG. 3.

The drive shaft 16 traverses these hubs and is surrounded by several parts making an axial seal assembly (see FIG. 5 and FIG. 6);

- a stationary seat 51 with a spherical back engaging a corresponding spherical cavity 52 in the hub 49; this arrangement provides good alignment and no leaks;
- a face seal 53 rotating with the shaft; a back-up ring 54 which contains several springs 55 pushing the face seal against the seat.

A short duct 56 installed at the top of the first-stage head acts as the admission port to the first stage. Located within this duct is a check valve assembly consisting of a seat 57, a disc 58, a rod 59 and a spring 60.

The duct 56 communicates with the compartment 61 which in turn communicates with the openings 47 in the inclined wall 40. The compartment 61 acts as a "plenum chamber".

The second compartment 62 which communicates with the outlet ports 46, also communicates via a passage 63 with the interior of the casing, this passage 63 being located close to the inner surface of the casing.

The rotor is surrounded with a concentric cylindrical sleeve 64 which is supported in a circular groove 65 in the first stage and in a circular groove 66 in the end wall 5. The sleeve has several large holes 67 which face the second stage intake section.

The boom 4 is surrounded by a tubular cam 68 which seats with its straight end on the end wall 5 and exposes an inclined plane surface towards the rotor's second stage end. This inclined plane surface is parallel to the plane surface 44 of the first-stage head. The piston-rods which are provided with inclined plane ends 69 are continuously guided by the cam 68.

Located between the sleeve 64 and the cylindrical wall of the casing are several concentric coils of tubing 70 separated by cylindrical baffles 71 and connected with their extremities to fittings 72, one of which admits a cooling fluid while the second discharges it.

The cooling fluid may be plain tap water or a coolant circulating through a low pressure radiator.

A well designed oil distribution system is important for the proper operation of the compressor because the oil fulfills many important functions: lubrication, sealing, cooling, pressure balancing.

The oil is delivered under pressure by a pump (not shown) to the oil inlet fitting 73 located on the first-stage head. The existence of this pump eliminates the need for maintaining a minimal discharge pressure when the compressor continues to operate "unloaded". A passage 74 in web 42 brings the oil to a radial passage 75 which communicates via a hole 76 with the oil cavity 77 in the outer periphery of the wall 38 and via a hole 78 with the oil cavity 79 in the inner periphery of the wall 39.

The oil from these cavities passes in the recesses 27 and 29 each of which contains a longitudinal oil groove 80 extending all the way to the annular wall 17.

Each recess 29 communicates via a radial hole 81 made in the drive end wall 15 with an annular cavity 82 surrounding the drive shaft at its junction with the wall 15. Closing this cavity is an axial balancing ring 83 fitted in the hub 50 of the first-stage head.

The oil grooves 80 in the recesses 27 communicate with an annular cavity 84 made in the annular wall 17 at the base of the sleeve 19. This cavity 84 feeds in turn three longitudinal oil holes 85 made in the wall of each high pressure cylinder 21; each hole 85 communicates in turn with a radial hole 86 made in the corresponding cover 22, this hole feeding the bushing 23.

The cavity 84 also feeds three longitudinal holes 87 in the three webs 88; each hole 87 communicates in turn with a radial hole 89 ending in the cylindrical bore surrounding the collector sector 10.

Each radial hole 89 connects with a short axial hole 90 located at a radius corresponding to the average radius of the cam.

Each vane has in its inclined plane face 34, an outer circular oil groove 91 which contacts continuously the circular arc recesses 27 and 29; and an inner circular groove 92 joined to 91 by several radial grooves 93.

The boom cavity 94 is closed by a cover 95 which supports a baffle assembly 96 inserted in the cavity. The cover has an outlet opening 97 which communicates with a gas-oil separator (not shown). The oil accumulated in the cavity 94 is expelled through a passage 98 equipped with a float 99 controlling the outflow of oil via an orifice 100 starting with a seat 101; this orifice in turn communicates with an oil tank (not shown). The oil accumulating in the casing 1 is channelled through the drain channel 102 to the passage 103 which communicates with the oil tank already mentioned.

For easy inspection and replacement of piston-vanes, the first-stage head can be pulled over four maintenance rods which are installed in four holes in the flange 2 when the bolts 36 have been removed. With the first-stage head pulled away from the casing and resting on the rods, the piston-vanes can be inspected and should it be necessary to replace them, then the rotor is pulled from the casing (into the first-stage head resting on the rods) thereby exposing the covers 22 which once removed will allow replacement of piston-vanes.

OIL SYSTEM OPERATION

The oil under pressure arriving into the cavity 77 follows several paths:

- fills the recesses 27 and the oil grooves 80 found in these recesses; it escapes via the vane-recess clearance and also through the outer circular groove 91 from which it passes also to the inner circular groove 92; finally it escapes via the vane-head—inclined plane clearance;
- it also escapes via the clearance between the outer periphery of the wall 38 and the inner periphery of the sleeve 19.

The oil under pressure arriving into the cavity 79 follows several paths:

- fills the recesses 29 and the oil grooves 80 found in these recesses, it escapes via the vane-recess clearance and also through the outer circular groove 91 from which it passes also to the inner circular groove 92; finally it escapes via the vane-head—inclined plane clearance;
- it also escapes via the clearance between the inner periphery of the wall 39 and the outer periphery of the cylinder 14.

The oil reaching the vanes seals, lubricates, cools and provides a hydrostatic thrust force on the vane-head, this force being almost equal to the highest axial loads encountered by the piston-vane unit, thereby leading to low friction and insignificant wear.

The oil which fills the cavity 82 exerts a hydrostatic force against the overall axial force exerted on the rotor and the balancing ring 83 allows a limited leak past the annular surface facing the rotor.

The oil arriving from the cavity 84, via holes 85 and 86, emerges in the bushings 23, which, in this way, are kept well lubricated and allow for longtime, wear-free operation of piston-rods.

The oil arriving from the cavity 84, via holes 87, 89 emerges in the very small clearances between the collector's surface and the cylindrical bore surrounding it; grooves in the collector's surface assure a seizure free operation. The small axial branch 90 creates a spray of oil directed to the inclined surface of the cam 68, hence lubricating the piston-rod ends 69.

Additional lubrification, sealing and cooling are obtained by the oil carried by the gas itself.

The oil draining from the first stage and that from the second stage (via a float control) are both cooled, filtered and reintroduced in the compressor after having passed through a pump which boosts the pressure to a value exceeding that of discharging gas-oil mixture from the second stage. Cooler, filter, pump as well as the oil pressure relief valve may all be installed within, on or around an oil tank which might be directly bolted to the casing legs 3.

Oil flow metering in various branches is achieved with adequate restrictions.

Both the intercooler section of the casing and the boom cavity 94 are protected with pressure relief valves set to the desired pressures; the return of these valves is the first stage inlet compartment 61.

The cooling obtained by the oil injected in the compressor at various locations reduces the discharge temperatures and the power consumption; it tends to maintain a good viscosity for the oil.

The fact that the intercooler coil surrounds the rotor helps in attenuating the noise level and, because of the continuous cooling action, the compressor can operate for extended periods even if "unloaded".

When the compressor is stopped with gas-oil under pressure both in the gas-oil separator and the casing (the receiver is isolated by a check valve between itself and the gas-oil separator), this gas would tend to turn the compressor into a motor with the gas discharging through the first stage inlet. This action is prevented by the check valve 58 installed in the inlet duct. The pressure would gradually drop if all the leaks are not completely eliminated (which is always the case) but the "motoring" action will definitely not take place.

LEAKAGE CONSIDERATIONS

For the present compressor, as for any other rotary compressor where mechanical sealing is difficult and expensive to use, the clearances between all the surfaces in relative motion must be sufficiently small to avoid excessive leaks between regions of different pressures and, at the same time, large enough to allow for unimpeded operation in the presence of thermal expansion, slight vibration, etc.

Since leakage is proportional to the pressure difference and the leakage area, it is of utmost importance to leave a minimum area when dealing with high pressure differences. This requirement is often in contradiction with the basic designs encountered in the rotary compressors, particularly in the vane types where leakage peripheries at high pressures are still too large and require larger quantities of oil for obtaining adequate sealing. Or too much oil causes increased power consumption.

In my invention, the double staging in a single rotor offers two advantages: that of the power saving resulting from intercooling and that resulting from the use of two different designs of working chambers, each best suited for the pressure differences encountered in the two-stages.

In the first stage the working chambers occupy the annular space 20 closed by the inclined plane surface 44. Their number exceeds by one that of the piston-vanes used; the "extra" chamber disappears when a vane slides past the radial recess 45. As the rotor turns, the volumes of the working chambers vary cyclically from zero to a maximum and then back to zero.

The leakage areas are found at:

- the inner and outer peripheries 28 and 30 of the annular space 20 and at the radial recess 45 for the inclined plane-rotor interface;
- the circular arc recesses 27 and 29 and at the circular openings 25 for the piston-vane—rotor interface;
- the gap between the inclined plane surface 44 and the inclined plane faces 34 of the vanes 32, for the vane-inclined plane interface.

Because the pressure differences in the first stage are quite small the resulting leakage remains acceptable.

In the second stage the working chambers are confined within the high pressure cylinders 21 which occupy the second half of the rotor 13. Their volumes vary cyclically from zero to a maximum and back to zero because the pistons 32 are forces to execute a reciprocating axial travel. The leakage areas within the cylinder are very small: the largest one is located at the gap between the cylinder outlet port 31 and the collector 10 and to minimize it, the surfaces must be well finished and the clearances kept to a minimum. The last condition requires an accurate assembly and in the present compressor this is achieved by supporting the rotor on two large bearings seating on the same rigid boom. Moreover, the collector is situated next to one of the bearings.

The overall leakage from the stages is reduced by surrounding the entire rotor with the intercooler; this arrangement offers simplicity and compactness by eliminating a separate intercooler with outside connections and offers a minimal pressure drop between stages. This leakage is further reduced by the fact that oil under pressure is injected into all the above mentioned leakage areas in a minimal quantity with a maximal effect.

OPERATION

When the compressor is fully assembled, the piston-vanes take axial positions dictated by the cooperating action of the inclined plane surface 44 and that of the cam 68.

As the rotor is turned, the lightweight vanes 32 slide with their inclined plane faces 34 over the inclined plane surface 44 while the piston-rod ends 69 remain in contact with the cam 68.

The inclined plane surface 44 maintains a continuous sliding contact in the radial recessed portion 45 with the conical surface 18, thereby leading to an operation with zero clearance volumes, hence with high volumetric efficiency in the first stage.

The gas to be compressed is admitted in the first stage chambers through the inlet duct 56, past the check valve 58 which opens with a very small pressure difference, through the inlet ports 47 which is positioned in a way to ensure complete filling of the working chambers when they have reached their maximum volumes and which is large enough for filling with very low pressure drop. The entire inlet section attenuates the entrance noise to a level which would even eliminate the need for a sound-proof enclosure. An added sound attenuation results from the use of air inlet filters (not shown). As the working chamber volume decreases from this maximum value, the gas is compressed and when the pressure between two consecutive vanes reaches the intercooler pressure value, the leading vane uncovers the outlet ports 46 and for the next approximate 50° of rotation, the compressed gas mixed with the injected oil is fully discharged into the outlet chamber 62 and from there, through the passage 63 into the annular space reserved, inside the casing, for the cooling coils 70.

The gas-oil mixture travels between the coils, is cooled and emerges partly separated through the holes 67 of the sleeve 64. It is then admitted in the second stage cylinders 21 via the intake sector 12 on the center boom and via the ports 31.

The outside diameter of the piston-rods 24 is such that the pressure inside the high pressure cylinders is equal to that in the intercooler at the beginning of the compression stroke. This pressure in turn is maintained at its best value by the pressure control valve 104. This action ensures minimal power consumption and involves a small quantity of high pressure gas bled into the inlet plenum chamber. Various final discharge pressures can be obtained by simply changing the piston-rod diameter and the covers 22.

During the first half of the compression stroke the port 31 passes over the closed section of the collector 10 and the pressure increases gradually to that of the final discharge value.

During the second half of this stroke, the port 31 communicates with the port 11 and the entire gas-oil mixture within the second stage cylinder passes into the boom cavity 94 where most of the oil drops out of the mixture because of the baffles 96; the oil collected in this manner passes into the oil tank via the float controlled orifice 100. The gas with very little oil is discharged into a gas-oil separator via the outlet opening 97.

The existence of several working chambers and lightweight piston-vanes ensures a pulsation free discharge and leads to an operation with small torque variations, full radial balance and a very small axial unbalance.

Since the piston-vanes are the only wearing parts (besides the bearings) and since their replacement cost is quite modest, the compressor offers an operation with low cost maintenance.

DOUBLE ACTING COMPRESSOR

Most of the previous descriptions and explanations fully apply to the double acting compressor. The common parts which appear on FIG. 12 (which is in fact a modified version of FIG. 1) are not numbered to avoid unnecessary repetition. The added and the modified components are properly identified and referred to in the following description.

Figure 12:
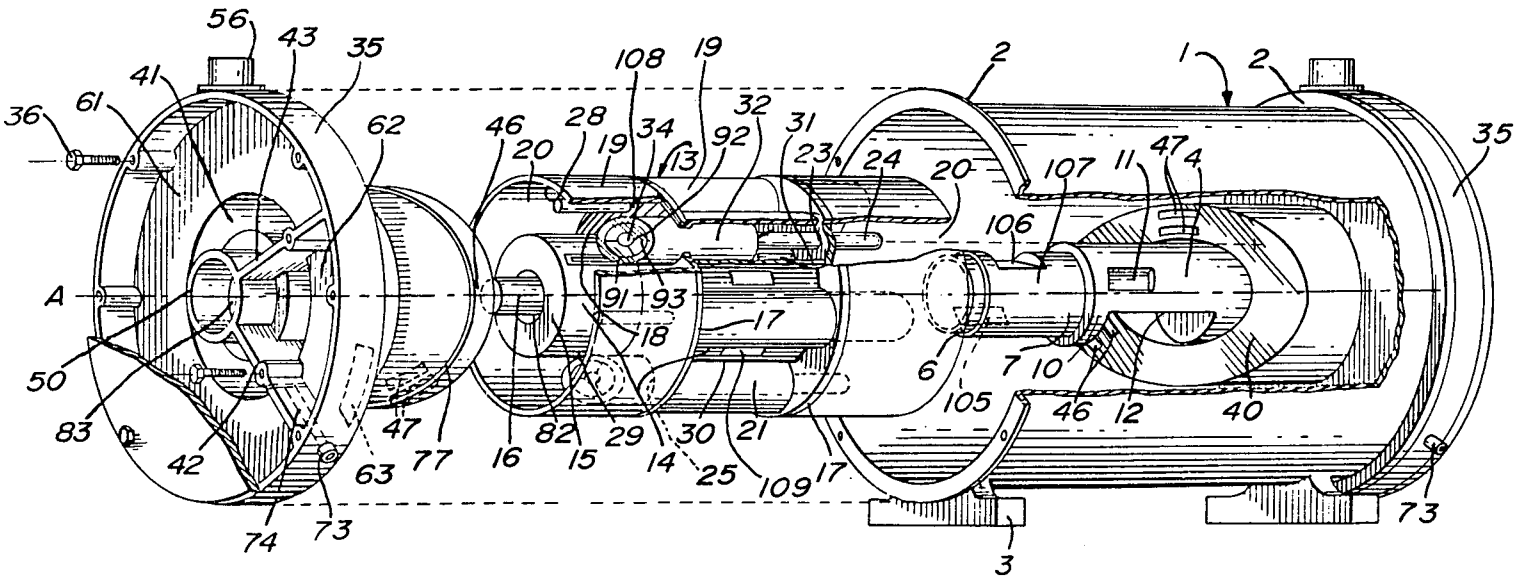
FIG. 12 is an exploded perspective view with parts partly broken away of a double acting compressor, (the cooling means have been removed for clarity).

As seen from the FIG. 12, the casing 1 has a second flange 2 to which is bolted a second first stage head 35 in many respects similar to that at the drive end. The two heads face each other with their inclined walls 40 parallel to each other. While the drive end head accommodates the drive shaft emerging from the rotor, the added head holds the center boom with all its arrangements seen in FIG. 4 and FIG. 5 with respect to the collection of air-oil, its separation, the discharge of air and oil etc.

The center boom 4 contains, in addition to the collector section 10 with the ports 11 and 12, a second collector sector 107 with ports 105 and 106 located at 180° with respect to 11 and 12. This added pair of ports near the first rotor support bearing serves the added set of three second stage cylinders 21 which replace the webs 88. The cylinder core 14 contains an added annular wall 17 with its own conical surface 18 and an added cylinder sleeve 19 which creates a second open ended space 20 facing the second first stage head. Each annular wall 17 contains at 60° intervals, three large diameter openings 25 and three smaller diameter openings 108, these two sets having the same circle for their centers. A large opening in a wall 17 is axially paired with a small opening in the other wall 17; each pair registers with the longitudinal axis of a hollow cylinder 21 which contains a piston-vane 32 identical to those already described. The large cylindrical portion slides in the respective annular cavity 20 and the large opening 25 while the piston rod 24 slides through the bushing 23 located within the opening 108 and emerges in the opposite annular cavity 20. Each piston-vane remains in continuous contact with the two inclined planes 40. The widths of the openings 46 and 47 are such that the remaining solid portions on the walls 40 provide adequate support for the small inclined ends 69. The cylindrical sleeve 14 has openings 109 between two adjacent cylinders 21, these openings communicating with the annular space surrounding the center boom 4 and hence with the ports 12 and 106.

The ports 31 in each cylinder 21, near the small openings 108 come in cyclic contact with their corresponding pair of ports 11–12 and 105–106 and allow the admission and expulsion of the gas as previously described. The oil from the pump is delivered under pressure to each oil inlet fitting 73 on each of the first stage heads and continues its flow through a distribution system which is substantially the same as for the single acting compressor. The radial holes 81, the annular cavity 82 and balancing ring 83 etc. exist only at the drive end. The radial holes 86 are made in the annular wall itself (since the covers 22 do not exist) and communicate with the bushings 23 and with the collector sectors 10 and 107.

Figure 4:
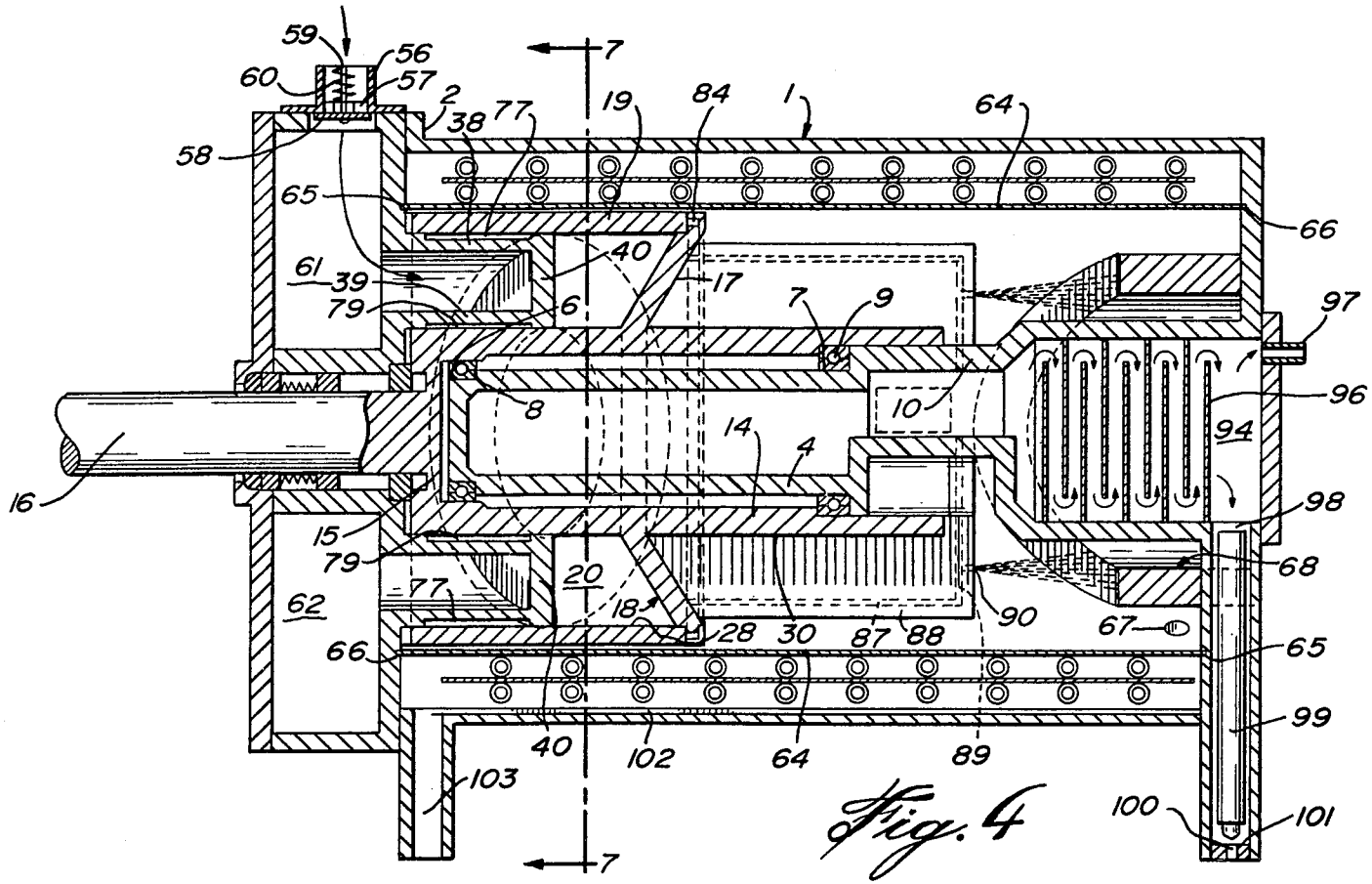
FIG. 4 is a cross-sectional view of the compressor taken along lines 4—4 of FIG. 3.

The first stage head at the non drive end provides a channel to accommodate the oil discharge arrangement illustrated in FIG. 4 and FIG. 5. The replacement of all six piston-vanes requires complete withdrawal of the rotor; each set is then pulled out from its corresponding large opening end. The already exposed leakage considerations and operation are not repeated since they fully apply to the double acting compressor which such as just described is capable of producing almost twice the output of a "single acting" compressor of same rotor diameter, same inclined plane angle and same rotation speed. The weight/output ratio is not quite halved because the rotor is longer and the small cam is replaced with the heavier first stage head. Evidently the casing is also longer but this feature allows for added room to place the additional intercooling coil required to handle the larger output. All considered, it is apparent that a "double acting" compressor could be cheaper than the equivalent "single acting" compressor of same output.

The embodiments of the invention in which an exclusive property or privilege is claimed are defined as follows:

1. In a two-stage compressor:

(a) a casing having opposite ends;

(b) a longitudinally extending center boom fixedly mounted centrally within said casing and having an end wall closing one end of said casing; said boom having: a hollow portion, defining a gas collecting sector and a gas passage sector, a first port for collecting compressed gas in said collecting sector and a second port for discharging said compressed gas from center boom;

(c) a rotor concentrically mounted on said boom, said rotor consisting of:

(i) a hollow cylindrical core;

(ii) a cylindrical sleeve concentrically surrounding a portion of said core to define therewith an annular space;

(iii) an annular wall joining said sleeve and said core, said annular wall having, on one side thereof, a frusto-conical surface; said wall having circular openings therethrough;

(iv) hollow cylinders longitudinally extending on the opposite side of said wall; said cylinders having one open end in axial registry with said circular openings in said wall, the opposite end being closed; the cylindrical bore of said cylinders having a diameter greater than the width of said space; each cylinder having a port adapted to come in cyclic registry over said first port of the boom;

(d) a first-stage head assembly closing the other end of said casing, said assembly including a pair of separate chambers and an inclined plane surface facing said frusto-conical surface; both said surfaces being in close proximity along a portion thereof, said plane surface including inlet and outlet ports thereon communicating respectively with the pair of chambers of said head assembly;

(e) cam means fixedly mounted in said casing and having an inclined plane surface extending parallel to the inclined plane surface of said head assembly; said cam means facing the closed end of said cylinders;

(f) cylindrical piston-vane means rotatably and axially displaceable within the bore of each said cylinders, each said piston-vane means including two coaxial adjoining bars of different outside diameters, the larger bar being substantially equal to the inside diameter of the cylindrical bore and the smaller bar traversing said closed end of said cylinder; said bars having free plane ends parallel to each other and inclined with respect to the common longitudinal axis thereof, the other end of said larger bar being perpendicular to said axis; the inclined end of said larger bar remaining in substantially continuous and complete sliding contact with the inclined plane surface of said first-stage head, the inclined end of said smaller bar remaining in substantially continuous and complete sliding contact with the inclined plane surface of said cam means; the rotation of said rotor causing a rotation of said piston-vanes around their own axis and their longitudinal displacement in said cylinders and in said annular space, to define first stage working chambers in said annular space and second stage working chambers within said cylinders;

(g) means for transferring gas compressed in said first stage working chambers to said second working chambers.

2. In a compressor as defined in claim 1, said transferring means consisting of an opening, in a wall of said first-stage head assembly, communicating with an intercooler section in said casing adjacent the inner wall thereof; said intercooler section being in fluid communication with said gas passage sector of said boom.

3. In a compressor as defined in claim 2, said intercooler section including coolant-carrying coils disposed in concentric arrangement and separated by oil-separating baffle means.

4. In a compressor as defined in claim 3, oil collecting channel means extending along the bottom of said casing.

5. In a compressor as defined in claim 1, said first-stage head assembly further including a check valve for admitting gas to be compressed.

6. In a compressor as defined in claim 1 or 5, said first-stage head assembly further including a pressure regulating valve for controlling pressure between said chambers of said first stage head assembly.

7. In a compressor as defined in claim 1, means for admitting and means for distributing lubricant between surfaces in relative sliding motion to lubricate, seal, cool and balance components of said compressor.

8. In a compressor as defined in claim 7, oil collecting baffle means in said gas passage sector of said boom.

9. In a compressor as defined in claim 8, a float valve means in fluid communication with said gas passage sector of said boom for evacuating oil collected therein by said baffle means.

10. In a compressor as defined in claim 7, webs extending peripherally about said core between said cylinders and longitudinally from said annular wall to the opposite end of said core; said lubricant distributing means including lubricating passage means in each said web terminating at said opposite end of said core with openings projecting a lubricating jet on said cam means.

11. In a compressor as defined in claim 10, said oil distributing means further including lubricant-carrying passages in said sleeve and said annular wall for conveying lubricant to said passages in said webs.

12. In a compressor as defined in claim 7, said lubricant distributing means further including lubricant-carrying passages in said first-stage head assembly for lubrication between said rotor and said assembly.

13. In a compressor as defined in claim 12, said lubricant admitting means are mounted in said head assembly.

14. In a compressor as defined in claim 7, said lubricant distributing means further including lubricant-carrying grooves in the inclined plane and of each said larger bar.

15. In a compressor as defined in claim 1, a self-aligning axial mechanical seal located between said first-stage head assembly and drive means for said rotor.

16. In a two-stage, double acting compressor:

(a) a casing having opposite open ends;

(b) two first-stage head assemblies closing each end of said casing, said each assembly including a pair of separate chambers and an inclined plane surface facing the interior of the casing, said surface including inlet and outlet ports communicating respectively with the pair of said chambers; said two heads being oriented so that their inclined plane surfaces are perfectly parallel to each other;

(c) a longitudinally extending center boom mounted centrally within said casing and being rigidly held by one of the said first stage heads; said boom having: a hollow section defining two gas collecting sectors, each equipped with two ports; a gas passage portion equipped with a discharge port; two bearing seats;

(d) a rotor concentrically mounted in said boom, said rotor consisting of:

(i) a hollow cylindrical core open at one end; bearings located within its bore; a drive shaft connected to the closed end;

(ii) two cylindrical sleeves concentrically surrounding the two ends of said core to define therewith two annular spaces;

(iii) two annular walls joining said sleeves, and said core each said annular wall having on one side thereof, a frusto-conical surface; each said wall having circular openings therethrough of two alternating different diameters with their centers on a same circle;

(iv) hollow cylinders longitudinally extending between said walls, said cylinders having one large open end in axial registry with said large circular opening in said wall, the opposing end having a smaller circular opening in axial registry with said smaller circular opening in said opposing wall; the cylindrical bore of said cylinders having a diameter greater than the width of said spaces; each cylinder having a port adapted to come in cyclic registry over said ports on the corresponding gas collecting sector on said boom;

(e) cylindrical piston-vane means rotatably and axially displaceable within the bore of each said cylinders, each said piston-vane means including two coaxial adjoining bars of different outside diameters, the larger bar being substantially equal to the inside diameter of the cylindrical bore and the smaller bar traversing said smaller opening at the end of said cylinder; said bars having free plane ends parallel to each other and inclined with respect to the common longitudinal axis thereof, the other end of said larger bar being perpendicular to said axis; the inclined end of said larger bar remaining in substantially continuous and complete sliding contact with the inclined plane surface of its respective first-stage head, the inclined end of said smaller bar remaining in substantially continuous and complete sliding contact with the inclined plane surface of the opposite first-stage head; the rotation of said rotor causing a rotation of said piston-vanes around their own axis and their longitudinal displacement in said cylinders and in said annular spaces, to define first stage working chambers in said annular spaces and second stage working chambers within said cylinders;

(f) means for transferring gas compressed in said first stage working chambers to said second working chambers.

* * * * *